US006196389B1

(12) United States Patent
Buetter et al.

(10) Patent No.: US 6,196,389 B1
(45) Date of Patent: Mar. 6, 2001

(54) ROLL DISPENSER PACKAGE

(75) Inventors: George Buetter; Fraser R. McCarthy, both of Toronto (CA); Joseph B. Schutte, III, Clarence; Barry Switzer, Williamsville, both of NY (US)

(73) Assignee: MDC Corporation Inc., Toronto (CA)

( * ) Notice: Subject to any disclaimer, the term of this patent is extended or adjusted under 35 U.S.C. 154(b) by 0 days.

(21) Appl. No.: 09/490,906

(22) Filed: Jan. 25, 2000

Related U.S. Application Data

(60) Provisional application No. 60/117,961, filed on Jan. 29, 1999.

(51) Int. Cl.[7] ..... B65D 85/66

(52) U.S. Cl. ..... 206/397; 206/411; 206/482; 206/493; 206/806

(58) Field of Search ..... 206/395–397, 206/408–411, 477, 478, 480–482, 461, 486–489, 39.8, 493, 806; 242/570, 590, 600

(56) References Cited

U.S. PATENT DOCUMENTS

| | | | | |
|---|---|---|---|---|
| 556,878 | * | 3/1896 | Benedict | 206/482 |
| 2,178,067 | * | 10/1939 | Cohen | 206/482 |
| 2,949,185 | * | 8/1960 | Foote et al. | 206/477 |
| 3,891,090 | * | 6/1975 | Spiegel et al. | 206/478 |
| 5,020,660 | * | 6/1991 | Akerley et al. | 206/396 |
| 5,197,606 | * | 3/1993 | Lancaster | 206/486 |

* cited by examiner

*Primary Examiner*—Luan K. Bui
(74) *Attorney, Agent, or Firm*—Jaeckle Fleischmann & Mugel, LLP

(57) ABSTRACT

A secure coiled roll paper product package using a hang card of resilient, tear resistant substantially flat stock with a pair of slots and integral arbor slit substantially in its center portion to form two contiguous halves that may be deflected to mount the coiled roll, the slots being dimensioned in relation to the coil to enable mounting of the coiled roll but substantially preventing removal of the coiled roll without tearing or otherwise defacing the card.

3 Claims, 2 Drawing Sheets

ROLL DISPENSER PACKAGE

This application claims the benefit of U.S. Provisional Application Ser. No. 60/117,961, filed Jan. 29, 1999.

This invention relates to the packaging and dispensing of coiled rolls of adhesive paper products such as postage stamps and based on our provisional application Ser. No. 60/117,961 filed Jan. 29, 1999.

The supply of postage stamps in coiled roll form is well known, as are dispensers for dispensing individual stamps from the coiled rolls. However, we have invented a very simple and inexpensive "point-of-sale" card, with certain security features, for packaging a stamp roll and capable of supporting the roll in order to function, if desired, as a dispenser.

An understanding of the invention can be obtained by reference to the accompanying drawings, in which.

Figure 1:
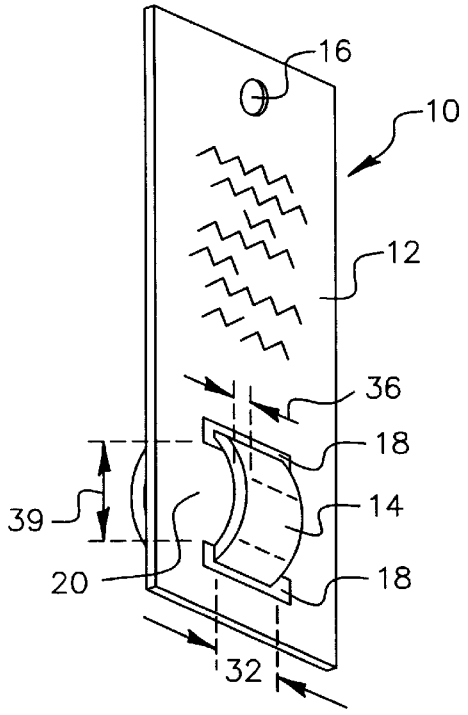
FIG. 1 is a perspective view of a preferred embodiment of a roll stamp package according to our invention and illustrating a roll of stamps supported by a point-of-sale hang card.

Referring to FIG. 1, there is shown a point-of-sale package 10 of postage stamps comprising a hang card 12 having mounted thereon a roll of coiled postage stamps 14 containing, e.g., 100 stamps. Card 12 is made of a suitable sturdy cardboard stock that resists creasing and tearing, but has sufficient resiliency and bending elasticity, such that the card stock can be bent to a limited degree at stress points, without causing any ruptures in the stock surface, and will return to its normal flat state after release. The card stock may be uncoated or coated with a suitable coating material such as polyethylene, and the completed card 12 may have printing or other indica thereon. Because of the simplicity of our invention, the roll of postage stamps 14 conveniently may be either of a self-adhesive variety, with or without an interleaved backing paper, or of the older variety that uses an adhesive which first must be moistened before affixing the stamps to envelopes. The hang card 12 may also include a suitable support hole 16 to hang multiple packages 10 on hooks at point-of-sale displays and on worm-screw feeders of self-service vending machines.

According to our invention, the stamp roll 14 is rotatably supported on hang card 12 by a flat arbor 20 integral with hang card 12 and formed by cutting a pair of slots 18 in hang card 12 and through which the roll 14 passes as shown.

Figure 2:
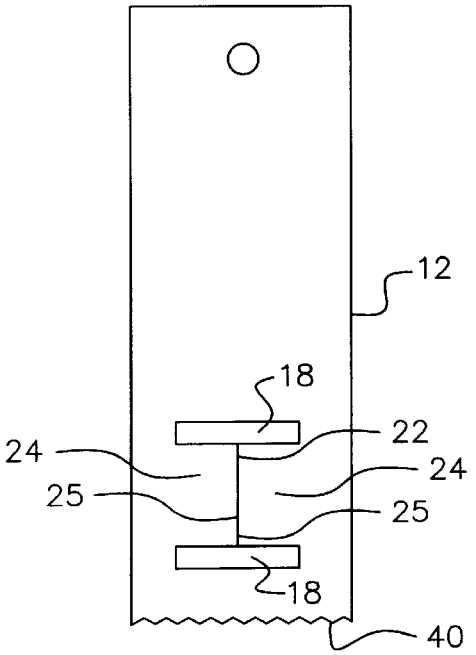
FIG. 2 is a front view of the card used in the package.
Figure 3:
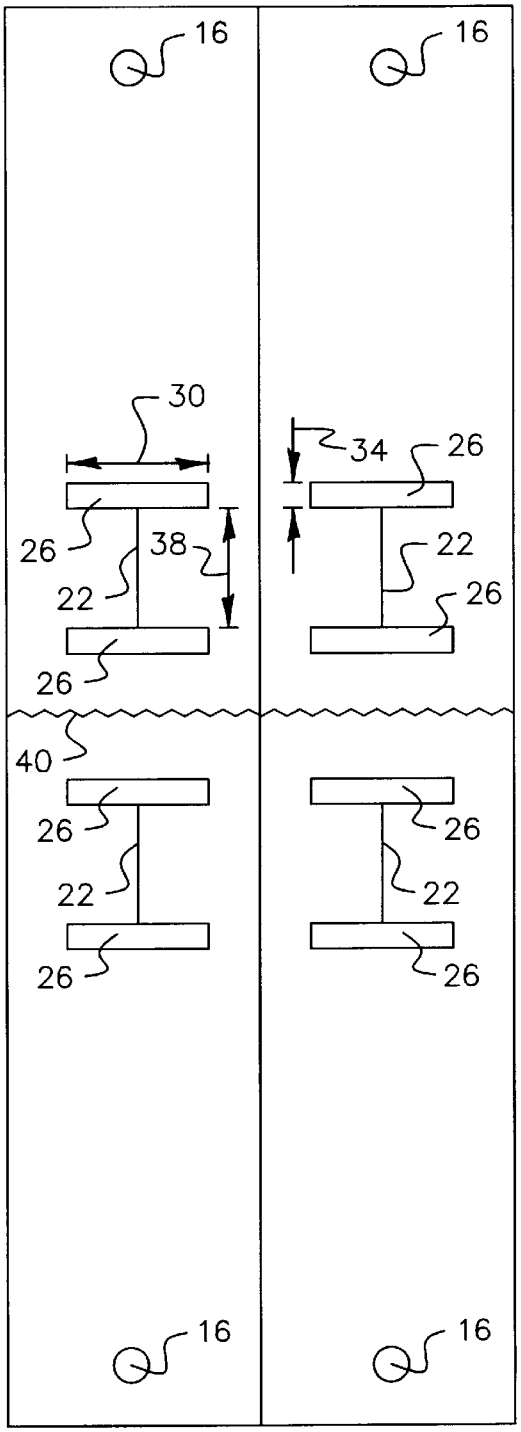
FIG. 3 is an illustration of the card stock blank from which the hang card is made.

In order to mount the roll 14 onto hang card 12, and by reference to FIGS. 2 and 3, we have provided arbor 20 with a central fine line cut 22 extending the full height of arbor 20 to form two separate arbor halves 24 contiguous at their inner ends 25.

To make card 12, a sheet of suitable card stock is cut to form a blank having the desired external dimensions for card 12, and, whether at the same time, before or after the cut to form the blank, the central cut 22 is made along with the removal of two substantially rectangular sections 26 to form slots 18.

To assemble the package 10, the two arbor halves 24 are deflected outwardly, by hand or suitable equipment, in the same direction. With the arbor halves held in the deflected position, a stamp roll 14 is then inserted by its hollow core over one of the deflected arbor halves 24 and then the inner end 25 of the other arbor half 24 tucked inside the hollow core of roll 14. Once both inner ends 25 are inside the open core of roll 14, the arbor halves 24 are released to enable them to return to their normal contiguous positions and thus form the arbor 20 on which roll 14 can freely rotate to permit the dispensing of individual stamps.

Notwithstanding the simplicity of our invention, the packaging concept surprisingly works to enable roll 14 to be inserted easily onto card 12, but nevertheless to prevent removal without tearing or substantially defacing card 12. This is possible because of the specific dimensions of slot 18 and arbor 20 in relation to the configuration and dimensions of roll 14.

By reference to FIG. 3, we have determined that the width 30 of each slot 18 preferably is within the range from about 110% to about 120% of the width 32 of stamp roll 14. Similarly, the height 34 of each slot 18 preferably is from about 110% to about 120% of the original thickness 36 of the stamp roll 14, and the height 38 of core 20 preferably is from about 85% to about 90% of the inner diameter 39 stamp roll 14. Of course if roll 14 includes a spool on which the roll of stamps is wound, the thickness of the spool will need to be included when measuring thickness 36. For example, for a typical roll of one hundred U.S. postage stamps wound onto a spool or core having a one inch inner diameter, width 30 and height 34 of slot 18 may be 1⅛ inches and ¼ inches, respectively, and the height 38 of core 20 may be about ⅞ inches. The card itself preferably can be about 2¼ inches wide by 6½ inches high for a 100 stamp roll, but these dimensions may vary as long as the card is wide enough to resist tearing and tall enough to discourage pilfering. By these and similar dimensions, it is possible to mount the roll 14 on arbor 20 without damage to the hang card 12, but any attempt to remove the roll 14 from the hang card 12 generally can be discouraged, as it will be difficult to remove it without tearing or defacing card 12.

To mount coil 14 on hang card 12, a hand assembler or equipment assembling the product need only deflect temporarily the two halves 24 of arbor 20 while roll 14 is being inserted. Once inserted and the arbor halves 24 restored to their normal contiguous positions, roll 14 is securely attached because of its width in relation to the length of slots 18, but any attempt to remove roll 14 will cause arbor 20 to tear or card 12 to be defaced. With a suitable cardboard stock that resists tearing, removal of the roll 14 will be significantly discouraged because of the amount of time that would be needed for any fraudulent attempt to remove the roll at point-of-sale. Although not required for the invention to work, a surface adhesive may be applied to the contiguous ends of arbor halves 24 at their inner ends 25, to join the arbor halves 24 and provide additional reinforcement.

Optionally, card 12 may be provided with a serrated edge 40 at its bottom end to assist in separating the stamps during use. For use with self-adhesive stamps, the card face also may be suitably covered with a release coating that prevents any stamps pulled from roll 14 from being accidentally affixed to card 12.

Figure 4:
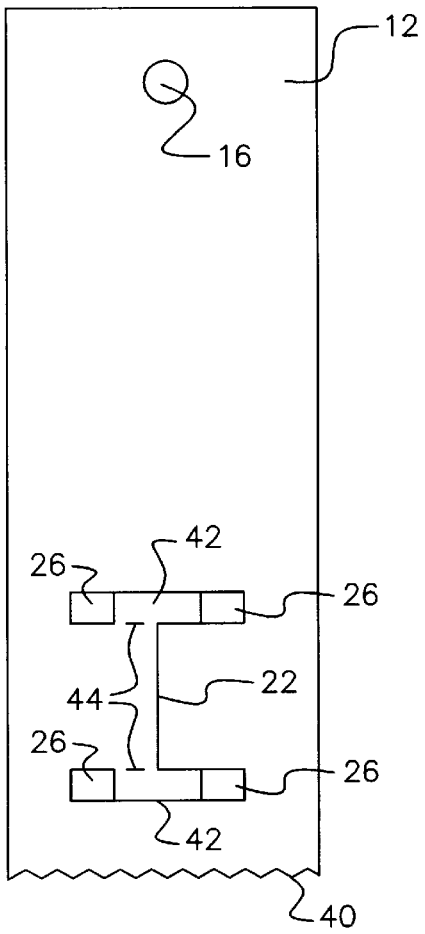
FIGS. 4 and 5 illustrate an alternate embodiment of the hang card.
Figure 5:
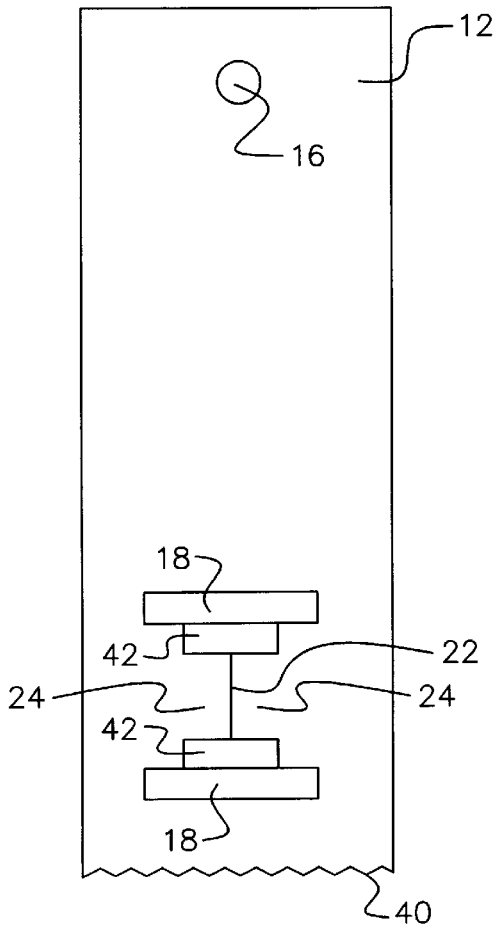

In the alternative embodiment as shown in FIG. 4, rather than entirely cutting out the entire rectangular sections 26, there may be left on card 12 partial tabs 42 attached to one of arbor halves 24 but scored at line 44 to permit folding over both arbor halves 24. In this embodiment, tabs 42 are coated on one side with an adhesive such as a pressure sensitive or hot melt adhesive and, during insertion of roll 14, are folded over the arbor half to which they are attached. After the two arbor halves are returned to their normal contiguous positions, the adhesive is then activated to secure the tabs 42 to both arbor halves 24 as shown in FIG. 5, thereby to increase the strength of the overall arbor 20. It also is possible to vary the length and width of tabs 42 and/or attach each the tabs 42 to opposite arbor halves 24 and still achieve the intended purpose.

The stamp package 10 may suitably contain a security protection device, such as a disposable electronic warning circuit affixed either to card 12 or to stamp roll 14 itself, and which is activated to sound an alarm on removal of package 10 from the sales premises unless deactivated at the point of purchase. In addition, a transparent shrink wrap material may used to enclose either the entire package 10 or just stamp roll 14. Of course, if the shrink wrap encloses only roll 14, then its thickness also needs to be taken into account when determining the dimensions of arbor 20 and slots 18.

It is now obvious that modifications can be made to the invention as described without departing from the spirit of the invention or the scope of the following claims.

We claim:

1. A secure product dispensing package comprising a cylindrical roll of discrete, substantially flat products formed continuously in a coil for dispensing from the coil, the coil having a predetermined width of substantial dimension and predetermined inner and outer diameters to define an original coil thickness; and a hang card comprising a single layer of resilient, tear resistant substantially flat stock, the hang card defining a pair of transverse elongate slots of substantially equal length and height, and an arbor comprising a single layer of the flat stock and having two ends integral with the hang card positioned between the slots and having a length substantially the same as the length of the slots, the arbor having a height less than the inner diameter of the coil with the coil being rotatably mounted on the arbor with diametrically opposed sides of the coil passing through the slots to permit rotation of the coil over the arbor as products are removed from the coil, the arbor having a slit between the two ends of the coil and along the entire height of the arbor to form two contiguous arbor halves, the slots and arbor being dimensioned in relation to the coil to enable mounting of the coil by deflection of the arbor halves but to substantially prevent removal of the coil from the hang card without tearing the arbor or otherwise defacing the hang card.

2. The package according to claim 1 in which the length of the arbor and the slots are from about 110% to about 120% of the width of the coil and the slots have a height from about 110% to about 120% of the original coil thickness, and the height of the arbor is from about 85% to about 90% of the inner diameter of the coil.

3. The package according to claim 1 and further comprising at least one tab formed integrally with one of the arbor halves and affixed to both arbor halves.

* * * * *